US010286442B2

(12) United States Patent
Takao et al.

(10) Patent No.: US 10,286,442 B2
(45) Date of Patent: May 14, 2019

(54) PRESS SYSTEM

(71) Applicant: AIDA ENGINEERING, LTD., Sagamihara-shi, Kanagawa (JP)

(72) Inventors: Ito Takao, Kanagawa (JP); Nishimura Tadashi, Kanagawa (JP)

(73) Assignee: AIDA ENGINEERING CO., LTD., Kanagawa (JP)

( * ) Notice: Subject to any disclaimer, the term of this patent is extended or adjusted under 35 U.S.C. 154(b) by 404 days.

(21) Appl. No.: 15/012,398

(22) Filed: Feb. 1, 2016

(65) Prior Publication Data

US 2016/0221063 A1 Aug. 4, 2016

(30) Foreign Application Priority Data

Feb. 2, 2015 (JP) ..... 2015-018892

(51) Int. Cl.

| | |
|---|---|
| ***B21D 45/04*** | (2006.01) |
| ***B30B 15/32*** | (2006.01) |
| ***B30B 1/26*** | (2006.01) |
| ***B30B 15/14*** | (2006.01) |

(52) U.S. Cl.

CPC ..... *B21D 45/04* (2013.01); *B30B 1/26* (2013.01); *B30B 15/14* (2013.01); *B30B 15/32* (2013.01)

(58) Field of Classification Search

CPC ..... B21D 43/05; B21D 45/00; B21D 45/04; B21D 43/055; B21D 28/002; B30B 1/26; B30B 15/14; B30B 15/32; B30B 11/027

See application file for complete search history.

(56) References Cited

U.S. PATENT DOCUMENTS 5,257,442 A * 11/1993 Tanaka ..... B23K 37/047 29/23.51

FOREIGN PATENT DOCUMENTS

| | | | | |
|---|---|---|---|---|
| JP | 49-013064 A | | 2/1974 | |
| JP | 63-97321 A | | 4/1988 | |
| JP | 07214399 A | * | 8/1995 | ..... B30B 1/261 |
| JP | 07214399 A | * | 8/1995 | ..... B30B 1/261 |
| JP | 11-138226 A | | 5/1999 | |
| JP | 2005-14062 A | | 1/2005 | |

(Continued)

OTHER PUBLICATIONS

Original document KR 20050006922 A to Lee is attached.*

(Continued)

*Primary Examiner* — Peter Dungba Vo
*Assistant Examiner* — Joshua D Anderson
(74) *Attorney, Agent, or Firm* — McDermott Will & Emery LLP

(57) ABSTRACT

A press system for knocking out a work from a lower die attached to a press machine has a cam 22 mounted on a bed of the press machine; a servo motor 21 which drives the cam to be rotated with the same cycle time as that of a drive mechanism of a slide of the press machine; a knockout pin 23 moved with reciprocal linear motion by the rotation of the cam; a detector 25 configured to detect a present angle information 24 of the cam, a memory storing a target angle information of the cam, and a controller 28 configured to control the servo motor in accordance with the present angle information and the target angle information. The controller is further configured to change a basic motion of the knockout pin according to contour of the cam to a target motion obtained from the target angle information.

5 Claims, 16 Drawing Sheets

(56) References Cited

FOREIGN PATENT DOCUMENTS

| | | | | |
|---|---|---|---|---|
| JP | 2010-115659 | A | | 5/2010 |
| KR | 20050006922 | A | * | 1/2005 |
| KR | 20050006922 | A | * | 1/2005 |

OTHER PUBLICATIONS

Machine translation for KR20050006922A to Lee is attached.*
Original document with english abstract for JP07214399A to Furuno is attached.*
Machine translation for JP07214399A to Furuno is attached.*
Machine translation of KR 20050006922 A to Lee retrieved from EPO website (Espacenet.com) on Apr. 25, 2018. (Year: 2018).*
Machine translation of JP 07214399 A to Furuno retrieved from ProQuest on Apr. 23, 2018. (Year: 2018).*
Office Action Japanese Patent Application No. 2015-018892 dated Jun. 28, 2016.

* cited by examiner

PRESS SYSTEM

CROSS-REFERENCE TO RELATED APPLICATIONS

This application claims priority to Japanese Patent Application No. 2015-18892 filed Feb. 2, 2015. The subject matter of which is incorporated herein by reference in entirety.

TECHNICAL FIELD

The present invention relates to press system and a work transfer system, which is used for a press machine and the like. More particularly, the present invention relates to a work knockout system which operates knockout pins with using, servo motor.

BACKGROUND ART

Patent Document 1 discloses a device in which a breakout punch (knockout pin) is operated by means of a cam. In the device, a rotational force from a crankshaft is transmitted to the cam so as to rotate the cam synchronously with the crankshaft and to operate the breakup punch. Since the device is interlocked with the press crankshaft, the knockout punch cannot be operated with single.

Further, Patent Document 2 discloses a knockout device characterized in that a Whitworth mechanism is used. In the knockout device, output force of a servo motor is increased by means of the Whitworth mechanism to generate a large torque at knockout operation.

Hitherto, there has been a transfer device, which transfers a work between dies of a transfer press machine or tandem press line. As shown in FIG. 13, the transfer device repeats a series of motions of clamping the work by left and right feed-bars, lifting-up, advancing forward, bringing down, releasing (un-clamping) the work to set on next press position, and return the feed-bars to the original position again.

PRIOR ART DOCUMENTS

Patent Documents

Patent Document 1: Japanese Patent Application Laid-Open No. 2005-14062

Patent Document 2: Japanese Patent Application Laid-Open No. 2010-115659

SUMMARY OF THE INVENTION

Problems to be Solved by the Invention

In accompanying of accelerating of press machine, further high-speed operation of knockout device and transfer device with keeping stable work transferring is required.

In the device of Patent Document 1, since the crankshaft is used as a rotational driving source for knockout operation, the operation amount and operating time of each knockout motion, that is, lifting-up, stopping, lowering-down and keeping cannot be changed individually and cannot be made variable. In order to change the motion individually or be made the motion variable, it is necessary to change the shape of the cam, and disassembly of the device is necessary, which are hard work.

Further, in this device, a transmitting means is necessary between the output shaft (the crankshaft) and the knockout pin, and the transmitting rout has a tendency to be longer. Therefore, elastic deformation of an elongated transmitting member due to a tensile stress provides some problems, such as, jumping of a knocked out work at knockout operation, and therefore, there is anxiety that transfer operation becomes unstable.

In the device of Patent Document 2, since a cam is swung by means of the servo motor, acceleration and deceleration in one cycle are large. Therefore, operating amount and operating time of lifting-up, stopping, lowering-down and keeping of each knockout motion is hard to make variable. In order to make variable, it is necessary to enlarge a capacity of the servo motor.

If the motion of knockout pin is variable, the knockout pin can be operate in most optimal timing in accordance with kind of the work. Then, sufficient margin of time is generated in the operation of the transfer device, that is, in the operation of clamping, transferring and releasing of the work for example. Further, stability of transferring of the work is improved to provide high-speed operation of press machine.

Then, the first subject of the present invention is to provide a press system and a transfer system, which generates a knockout motion with optimal timing with simple construction.

On the other hand, when a transfer device is operated in high speed to accord the accelerated press processing speed, work-handling, such as gripping of work and releasing or un-gripping to put the work on a die, becomes unstable. When, handling is performed in high-speed, even though the timing is optimized, substantial time becomes shortened.

Therefore, the second subject of the present invention is to provide the press system which improves stability of the work handling.

Further, the third subject of the present invention is to provide a press system which operates a knockout device in optimal timing and progress the stability of the work handling.

Means to Solve the Subjects (1) The present invention is directed to a press system for knocking out a work from a lower die attached to a press machine; the press system comprising: a cam mounted on a bed of the press machine; a servo motor which drives the cam to be rotated with the same cycle time as that of a drive mechanism of a slide of the press machine; a knockout pin which is moved with reciprocal linear motion by the rotation of the cam; a detector configured to detect a present angle information of the cam; a memory storing a target angle information of the cam; and a controller configured to control the servo motor in accordance with the present angle information and the target angle information, the controller being further configured to change a basic motion of the knockout pin according to contour of the cam to a target motion obtained from the target angle information.

"Present angle information" is a concept including not only a cam angle or phase but also including amount or value which can be converted to the cam angle, such as counting of an encoder. In the embodiment mentioned bellow, the present angle information accords to the present angle of the cam as an output of a rotary encoder.

"Target angle information" is a concept including the information of the angle or phase to be directed as a target, and an information of amount or value corresponding to them. In the embodiment mentioned bellow, the target angle information corresponds to the target angle of the cam.

"Motion" is a concept including a time-based displacement of knockout pin obtained from the cam and the servo motor driving the cam.

"Knockout motion based on a shape of cam" means a motion of knockout pin in a state that the angle of the cam is accorded to the angle of the crankshaft of the press machine.

"Target motion of knockout" means a predetermined lifting motion as a target of the knockout pin in accordance with a crankshaft angle.

(2) In the above-mentioned press system, further comprising: a knockout bar mounted on a frame of the press machine in a manner capable of up and down motion, the knockout pin being supported by an upper side of the knockout bar; a roller attached on a lower side of the knockout bar, so that the roller rolls along the contour of the cam; and an urging member which urges the knockout bar toward the cam so that the roller abuts to the cam.

(3) Further, it is preferable that the obtaining means obtains the target angle information according to a periodic motion of the drive mechanism of the press machine, with reference to a data table preliminarily registered in the memory.

"Obtaining means" corresponds to S2*a* and S2*b* in the embodiment.

(4) Further, it is preferable that the knockout system further comprises a calculator configured to calculate the target angle information based on the periodic motion of the drive mechanism of the press machine.

(5) A press system of the present invention is characterized in that the system comprises a cam mounted on a bed of the press machine; a servo motor which drives the cam to be rotated with the same cycle time as that of a drive mechanism of a slide of the press machine, a knockout pin which is mounted on a die of the press machine, and which takes reciprocal linear motion by the rotation of the cam; and a transfer device which transfers a work or works; wherein, the cam lifts up the knockout pin and the transfer device arranges the work on a position in which the work is in contact with an upper surface of the knockout pin or a neighborhood thereof; and the cam takes down the work together with the knockout pin to set the work in the die of the press machine.

(6) Another aspect of the press system of the present invention is characterized in that the system comprises a cam mounted on a bed of the press machine; a servo motor which drives the cam to be rotated with the same cycle time as that of a drive mechanism of a slide of the press machine, a knockout pin which is mounted on a die of the press machine, and which takes reciprocal linear motion by the rotation of the cam; and a transfer device which transfers a work or works; wherein the transfer device is configured to temporarily hold the work put in the die in such manner that the work can be moved in a direction in which the knockout pin takes the reciprocal linear motion; and the knockout pin knocks out the work so that the temporarily held position is shifted.

(7) In the press system mentioned above, the transfer device securely holds the work with adding a grip force, after the knockout pin knocked out the work.

(8) Further another aspect of the press system of the present invention is characterized in that the system comprises a knockout pin and a transfer device which transfers a work; wherein, the knockout pin is lifted up; the work is arranged on a position in which the work is in contact with an upper surface of the knockout pin or a neighborhood thereof by the transfer device; and the work is taken down together with the knockout pin to set the work in a die of a press machine.

(9) Further another aspect of the press system of the present invention is characterized in that the system comprises a knockout pin and a transfer device which transfers a work; wherein the work put in a die of a press machine is temporarily held by the transfer device in such manner that the work can be moved in the knockout direction; and the work is knocked out by the knockout pin so that the temporarily held position is shifted.

(10) Further, it is preferable to securely hold the work with adding a grip force, after the knockout.

Effect of the Invention (1) The press system of the present invention can accelerate, decelerates, keeps constant, and stops a servo motor so as to assist the motion of a knockout pin based on a cam contour which is a base of motion. Therefore, optimal timing motion of the knockout pin can be obtained by varying basic motion based on the cam contour, without increasing capacity of the servo motor.

(2) In such case that the knockout system mentioned above further has a knockout bar mounted on a frame of the press machine in a manner capable of up and down motion, the knockout pin being supported by an upper side of the knockout bar; a roller attached on a lower side of the knockout bar, so that the roller rolls along the contour of the cam; and an urging member which urges the knockout bar toward the cam so that the roller abuts to the cam, a certainty of the motion of the knockout pin is high.

(3) Further, in such case that the obtaining means obtains the target angle information according to a periodic motion of the drive mechanism of the press machine, with reference to a data table preliminarily registered in the memory, the motion can be easily changed to the target motion by preparing multiple data tables.

(4) Further, in such case that the knockout system further comprises a calculator configured to calculate the target angle information based on the periodic motion of the drive mechanism of the press machine, the motion can be changed to a target motion more easily.

(5), (8) in the press system of the present invention, since a work can be hold in a die with preventing trouble of dropping by using a knockout pin as a lifter. Therefore, a transfer of the work can be more stable.

(6), (9) In the press system of the present invention, a popping out of a work due to a knockout pin can be prevented by temporarily holding. Therefore, a transfer of the work can be more stable.

(7), (10) When, the work is securely held with adding a grip force, after a knockout, a temporarily hold can be smoothly transmitted to a securely holding. Therefore, a transfer of the work can be more stable.

BRIEF DESCRIPTION OF THE DRAWINGS

[FIG. 7] A diagram showing working state of a slide, a knockout pin, and the like.

[FIG. 10]

[FIG. 11]

[FIG. 12]

MODES FOR CARRYING OUT THE INVENTION

1. Outline of Press Machine

Figure 1:
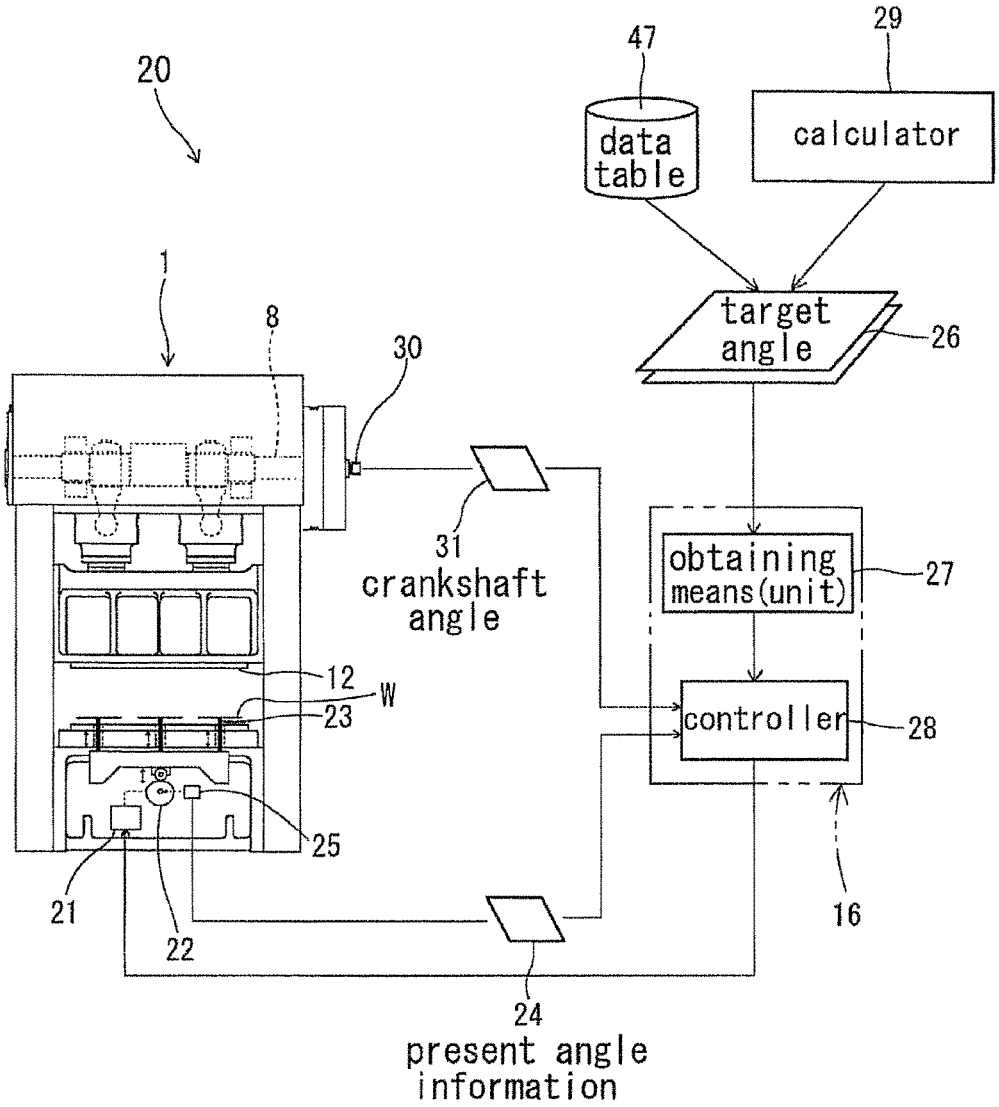
[FIG. 1] is a block diagram showing a press system according to an embodiment of the present invention.

At first, with reference to FIG. 2, outline of a press machine 1 which is used for present invention will be explained. A press system 20 (see FIG. 1) and a transfer device 14 of the present invention are used in the press machine 1. The drawing shows a state that a slide is situated in an upper dead point. The press machine 1 in the drawing has a so-called integral-type straight side frame 2. As such frame 2, a ring frame made of a bed 3, side walls 4 standing up from the side ends of the bed 3 and an upper member 5 which are integrated as one body, can be employed. A bolster 6 is mounted on the upper surface of the bed 3. Beside, as a frame, a C-type frame or the like can be used.

On the upper member 5 of the press machine 1, a motor 7 to drive the press machine, a fly wheel 7*a* driven by the motor 7 through a belt 7*c*, a crankshaft 8 to which rotational force of the fly wheel is transmitted, and a connecting rod 9 which is driven up-and-down by the above-mentioned members. The slide 10 moves up and down through the connecting rod 9. Up-down motion of the slide 10 is guided by slide gibs 11 attached to the side walls 4. An upper die 12 is attached to the under surface of the slide 10, and a lower die 13 is attached to the upper surface of the bolster 6. The above-mentioned transfer device 14 to transfer work W to be processed toward next stages is attached on the lower die.

Beside, a servo motor can be employed as the motor for driving the press machine, and rotational torque can be directly transmitted to the crankshaft 8 without intervene the fly wheel 7*a* and clutch 7*b*.

Figure 13:
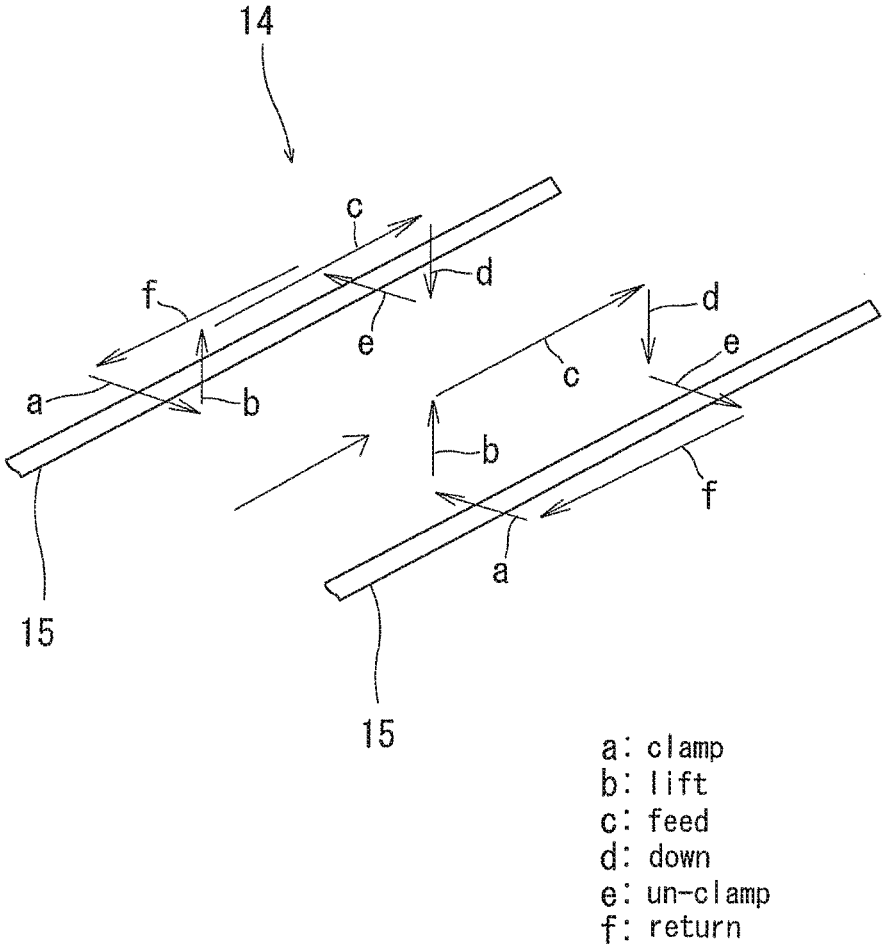
[FIG. 13] A schematic view showing a operating state of feed bars.

The transfer device 14 in the embodiment is a known type of device which has a pair of feed bars 15, 15 as shown in FIG. 13.

2. Outline of Press System

Figure 2:
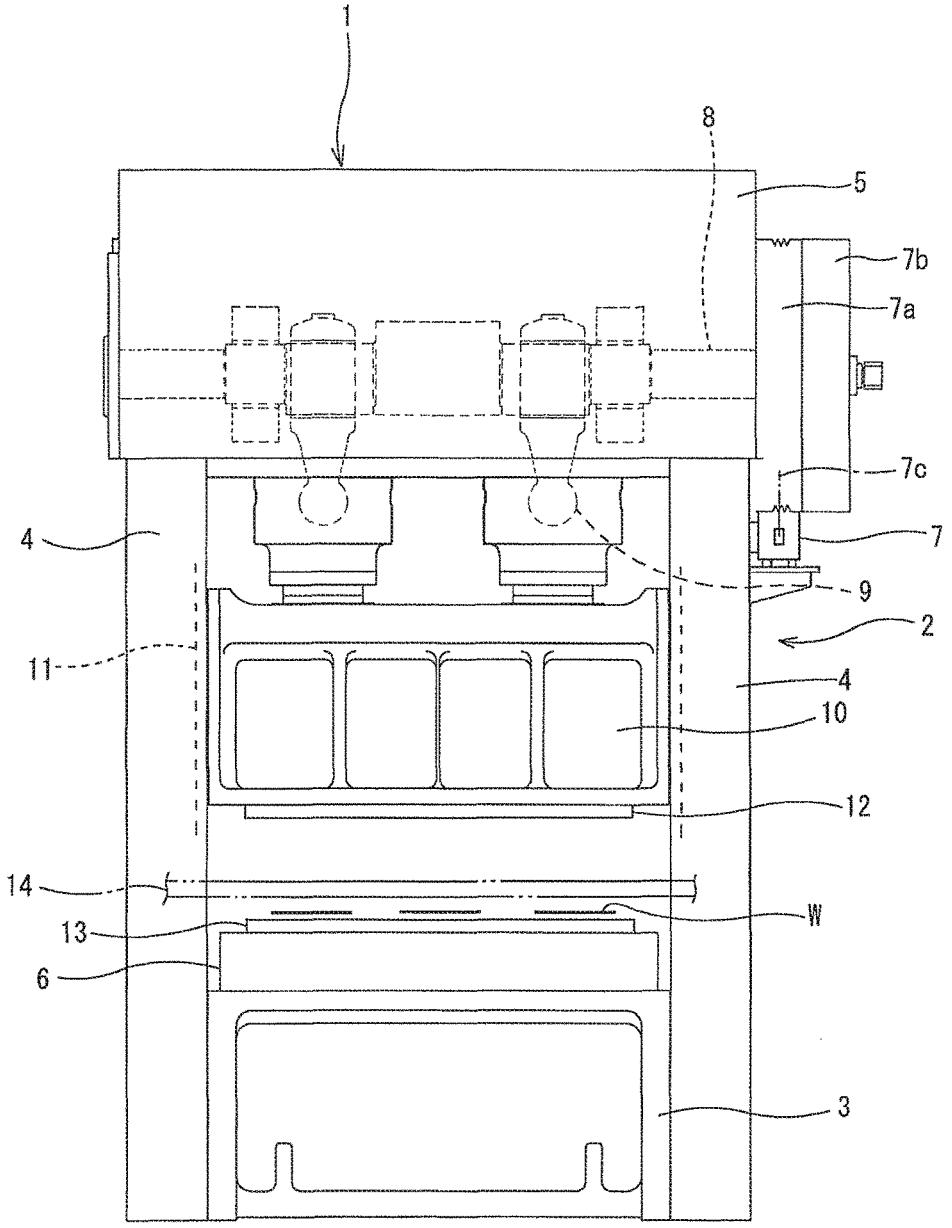
[FIG. 2] A front view showing an example of a press machine in which the press system of the present invention can be used.

With reference to FIG. 1, outline of an embodiment of a press system of the present invention will be explained.

This press system 20 is a system for knocking out a processed work W from a lower die 13 attached on a press machine 1. The press system 20 has a servo motor 21, a cam 22 which is rotated by drive of the servo motor, a knockout pin 23 which is moved with reciprocal linear motion by means of the rotation of the cam, a present angle detector 25 for detecting a present angle information 24 (present angle of the cam) including present angle of the cam, an obtaining means (unit) 27 which obtains a target angle information 26 (target angle of the cam) including a target angle of the cam, and a controller 28 for controlling the servo motor based on the present angle and the target angle.

The obtaining means 27 and the controller 28 are configured in a control unit 16.

Beside, the work can be taken out from an upper die 12 by means of the knockout pin 23.

In the present embodiment, a period of the rotational cycle of a crankshaft 8 which drives the press slide up-and-down is the same as the period of the rotational cycle of the cam 22 which drives knockout pin 23. And, a lifting amount of the knockout pin 23 is based on a rotational angle (phase) of the cam.

The servo motor 21 is operated to coincide with a predetermined motion of the crankshaft in the press machine 1. The crankshaft 8 of the press machine 1 is provided with a crankshaft angle detector 30 to detect information of an absolute angle of the crankshaft, such as rotary encoder. The servo motor 21 rotates so as to coincide based on a crank angle 31. The crankshaft angle 31 is a concept including value that can exchange to an angle. Further, the member to be detected an angle is not only the crankshaft, but also another member which can show an rotational angle of the crankshaft 8, such as an output shaft of a motor to drive the press machine.

Beside, though, a crankshaft is used in the present embodiment, another mechanism which can drive a slide can be employed. For example, an eccentric mechanism, such as an eccentric shaft, eccentric sheave, and the like, or eccentric mechanism to operate a link mechanism can be employed.

3. Hardware Structure

In the press machine 1 in the present embodiment, a computer is used. The computer is provided with a CPU 40. To the CPU 40, a nonvolatile memory 41, a volatile memory 42, a drive 44 accessible to various devices 43 or media such as optical storage device (for example DVD), a magnetic storage device, and a communication circuit 45 to communicate with outside through network are connected through a bus line 46. Further, in the nonvolatile memory 41, data table 47, program 48, 49 to process the press system of the present invention, and an OS 50 (operating system) are stored.

The program 48, 49 operates with using function of OS 50 or with individual operation. For example, the program 48, 49 and OS 50 are stored in DVD 43 and are installed though the drive 44 or communication circuit 45.

In the embodiment, the function shown in FIG. 1 is realize by using the CPU 40 and basic program 48 or modified program 49. However, a part or the whole of the function, for example control unit 16, can be realized by a logical circuit such as microcomputer.

4. Flow Data, Etc.

Figure 4:
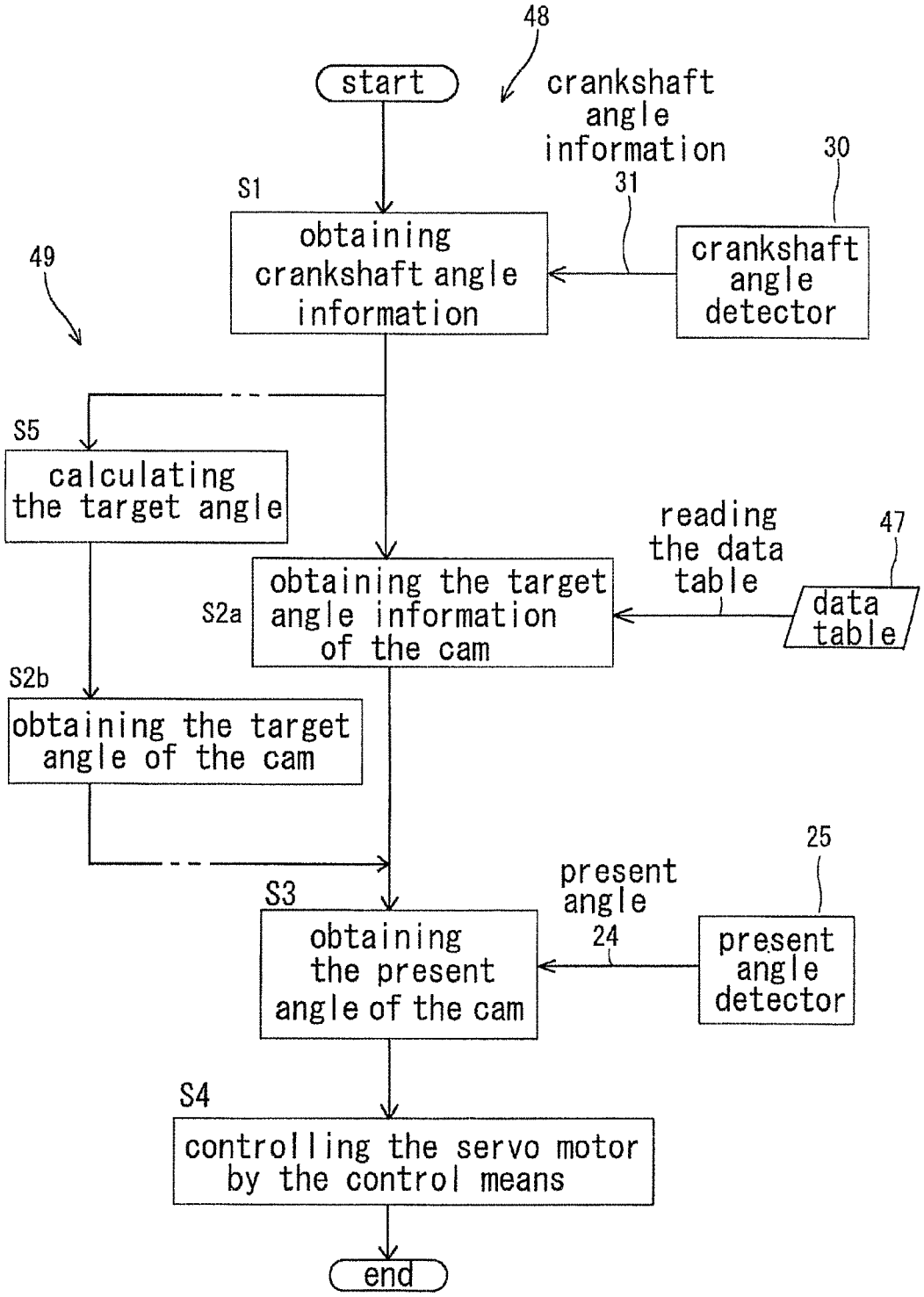
[FIG. 4] A flow chart or flow data showing an embodiment of a process according to the present invention.

Next, on reference to FIG. 4, a flow data or flow chart showing an example of a process flow which includes program 48 used in the press system 20 will be explained.

(S1) At first, the CPU 40 gains a rotational angle, i.e. the crankshaft angle information 31 of the crankshaft of the press machine, from the crankshaft angle detector 30 at a prescribed timing.

Figure 3:
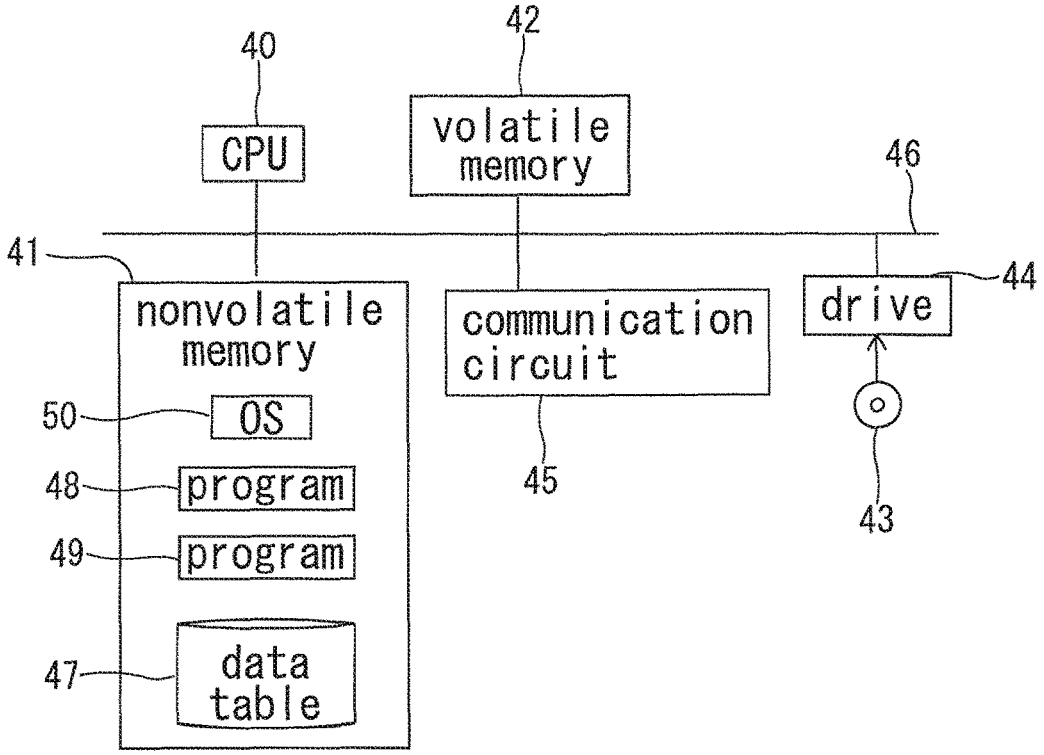
[FIG. 3] A schematic view showing an embodiment of a hardware construction according to the present invention.

(S2) Next, the obtaining means 27 refers the data table 47 stored in the nonvolatile memory 41 or alternatively in volatile memory 42 (see FIG. 3) and obtains the target angle 26 of the cam corresponding to the crankshaft angle 31.

Data Table

Figure 5:
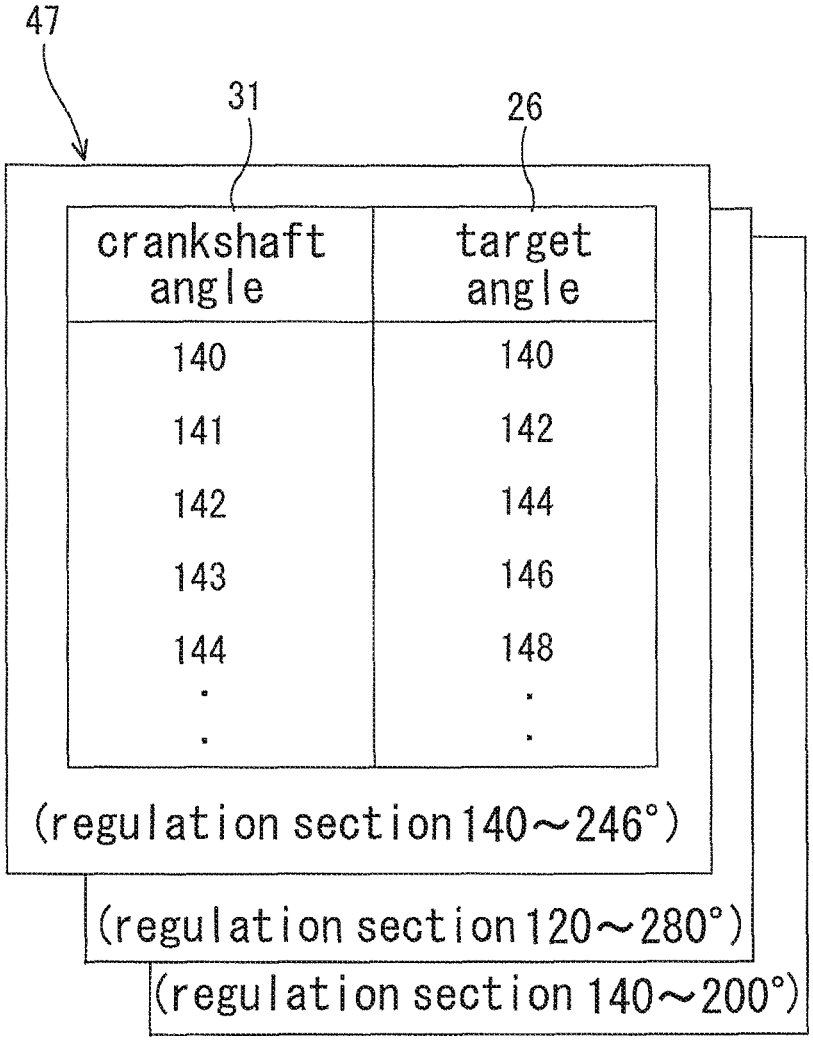
[FIG. 5] A schematic view showing an embodiment of a data structure of the data table.

FIG. 5 shows an example of a data structure of the data table 47. In the data table 47, the target angle 26 of the cam corresponding to crankshaft angle 31 of the crankshaft of the press machine is described. A motion curve of the knockout pin to be a target can be obtained by the target angle 26.

Besides, the motion curve of the knockout pin means a graph in which crankshaft angle of press machine is shown in an axis of abscissa and knockout lift amount is shown in an axis of ordinate, that is, a diagram showing a lift amount of a knockout pin corresponding to a crankshaft angle of a press machine.

Usually, plural data tables are prepared to operate the cam so that a work W is knocked out in optimal timing for respective work.

Returning to FIG. 4, (S3) Then, the present angle detector 25 detects the present angle 24 of the cam 22 at the same timing as the crankshaft angle 31.

(S4) The detected present angle 24 and the target angle 26 obtained from the obtaining means 27 are further obtained by the controller 28, and the servo motor 21 is feedback-controlled by the information.

Then, the flow of one stroke of the press machine is terminated.

Figure 6:
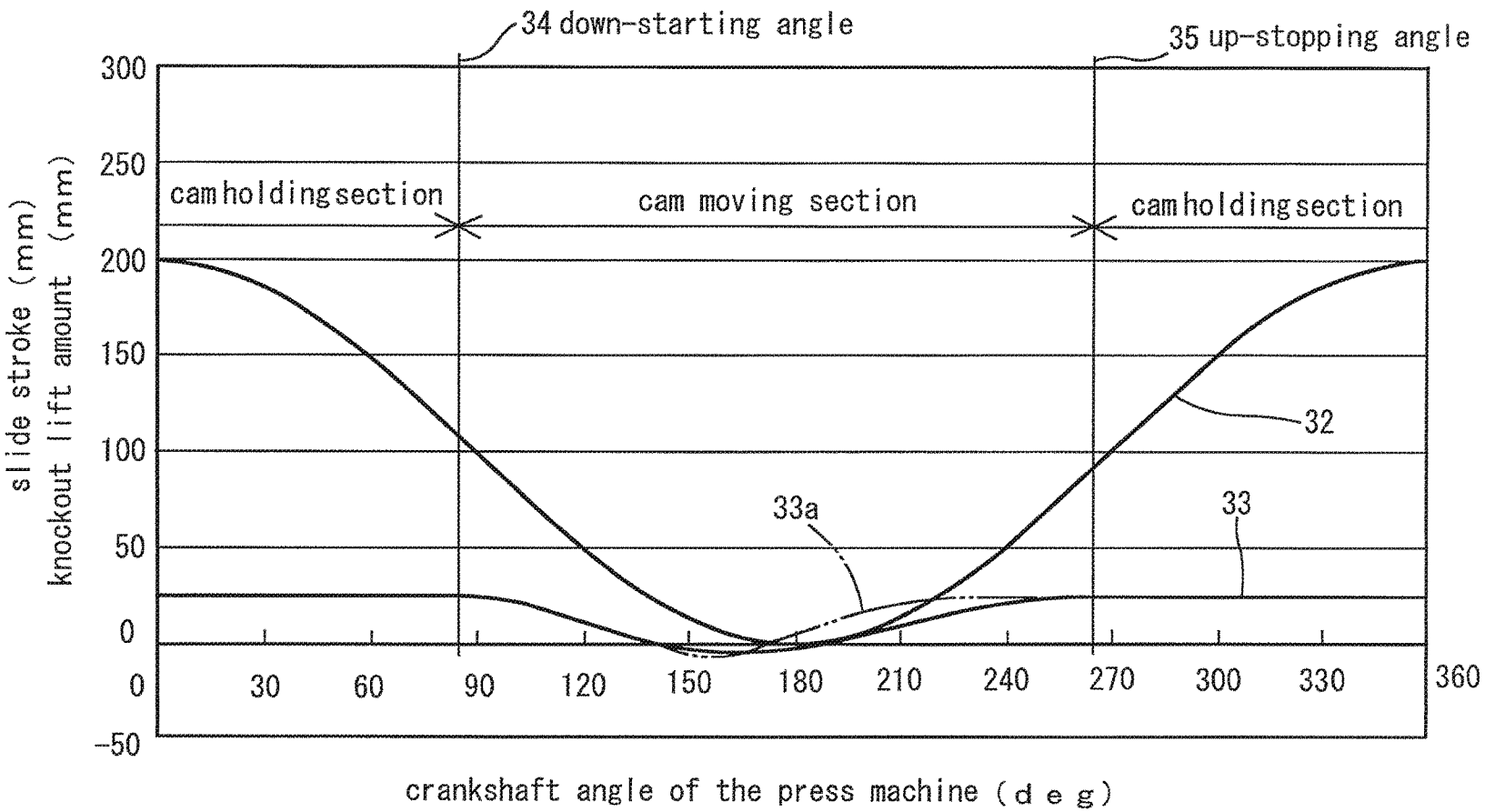
[FIG. 6] A diagram showing a slide curve and a target motion curve of a knockout pin.

Next, with reference to FIG. 6 showing a timing diagram of the slide and knockout pin, control operation of the controller 28 (see FIG. 1) is explained in detail.

At first, the axis of abscissa in the drawing shows a rotational angle (deg.) of the crankshaft, and the axis of ordinate shows a stroke (mm.) of slide corresponding to the rotational angle (deg.) of the crankshaft of the press machine. The numeral 33 denotes a motion curve of the target motion of the knockout pin, which is lift amount (mm.) of the knock out pin corresponding to the rotational angle (deg.). The motion curve 33 is a target motion curve which is changed or arranged from a motion curve 33 of the knockout pin based on the shape of the cam 33 (see two-dot-chain line in the drawing) in order to obtain a suitable timing for a certain work. The motion curve of the knockout pin shown by the two-dot-chain line based on the shape of the cam 22 corresponds to a motion curve in which the rotational angle is accorded to the rotational angle of the press crankshaft.

The numeral 34 in the drawing denotes a starting angle when the knockout pin comes down with following the shape of cam, and the numeral 35 denotes a stopping angle when the knockout pin comes up. That is to say, the section from the down-starting angle 34 to the up-stopping angle 35 is a cam moving section where the up-down position of the knockout pin changes with following cam shape. And the section from the up-stopping angle to down-starting angle is a cam holding section where up-down position of the knockout pin does not change and a state that the knockout pin projects is kept. In this embodiment, the angle of the cam moving section is 180 degree. That is, the standard angle is 180 degree.

In order to obtain a target motion curve 33 of the knockout pin 23 shown in the timing diagram of FIG. 6, the servo motor 21 is controlled so as to assist the rotation of the cam 22 by acceleration, deceleration, and the like. Hereinafter, an explanation will be more concrete. An angle section where it is necessary to modify the motion curve based on the shape of the cam 22 is named as a "regulation section". In the drawing, the regulation section is in 140 to 246 degree. The target angle of the cam 22 corresponding to the crankshaft angel in the regulation section is calculated and registered in the data table previously. For some regulation sections, data tables in which target angles of the cam 22 corresponding to rotational angle of crankshaft of a press machine are arranged, are prepared, and files each corresponding to the selected regulating sections are read. Then the controller 28 controls the drive of the servo motor 21 so that the target angle 26 of the read data table 47 is aimed.

That is to say, in order to deform the motion of the knockout into a set up target motion, the drive of the servo motor 21 is controlled so that the rotation angle (phase) of the cam 22 becomes a target angle (phase) which is set in relation to the angle (phase) of the crankshaft.

In the present embodiment, the rotational angle of the cam 22 delays somewhat to the press crankshaft angle.

Beside, in the present embodiment, since the regulation section is in the cam moving section based on the shape of the cam, the rotational velocity of the cam is accelerated and decelerated in the cam moving section. However, when the regulation section extends to the outside of the area of the cam moving section, the cam rotation can be accelerated or decelerated in the cam holding section based on the cam shape.

Automatic Calculation

With reference to the flow chart of FIG. 4, another embodiment of process flow used the press system 20 which includes another program 49 (see two-dot-chain line) will be explained. Since this process of the flow chart is the same as the above-mentioned process, detail explanation will be omitted with attaching the same mark or same numeral to the same portion or member.

(S5) This flow chart is characterized in that a calculation process (S5) and obtaining data of cam target angle (S2*b*) are employed in place of the obtaining data of cam target angle (S2*a*) by reading from the data base 47.

In the calculation process (S5), a target angle 26 of the cam which is converted to necessary lifting amount of the pin is calculated from the obtained crankshaft angle 31.

For example, the target angle 26 from the data table 47 and automatic calculation is based on the cam shape. The optimal cam shape varies to respective die. How to lift and lower the knockout pin 23 in relation to the press crankshaft angle is determined on the base of the optimal cam shape, for example, "target motion of knockout" (see mark 39 in FIG. 7). This optimal cam shape, for example, can be calculated from the following various conditions and the like (see explanation about FIG. 10). That is to say, the area where regulation by the servo motor is possible is determined on the basis of the obtained optimal shape of the cam, for example, a capacity of the servo motor. Therefore, from the area where the regulation is possible, a motion of the servo motor in relation to the crankshaft angle 31 is calculated.

As mentioned above, the method using a data table 47 is such a method that, for example, an optimal cam shape (e.g. "target motion of knockout") and a motion of a servo motor or the like are previously calculated, and a list or table is made of the result of calculation and is read and stored. On the other hand, the automatic calculation method is such method that the calculated value stored in the data table 47 is calculated in real time, for example.

When the reduction ratio of a reduction gear 21*a* (see FIG. 8) of the servo motor cannot divided by whole number and reminder leaves, the number of rotations of the servo motor for one rotation of the crankshaft is not whole number. Therefore, the servo motor is processed in control manner, so that there is no error of phase, by adding leave of the reduction ratio in the servo motor 21. For example, the phase of the servo motor is reset to zero every one revolution of the crankshaft.

Figure 7:
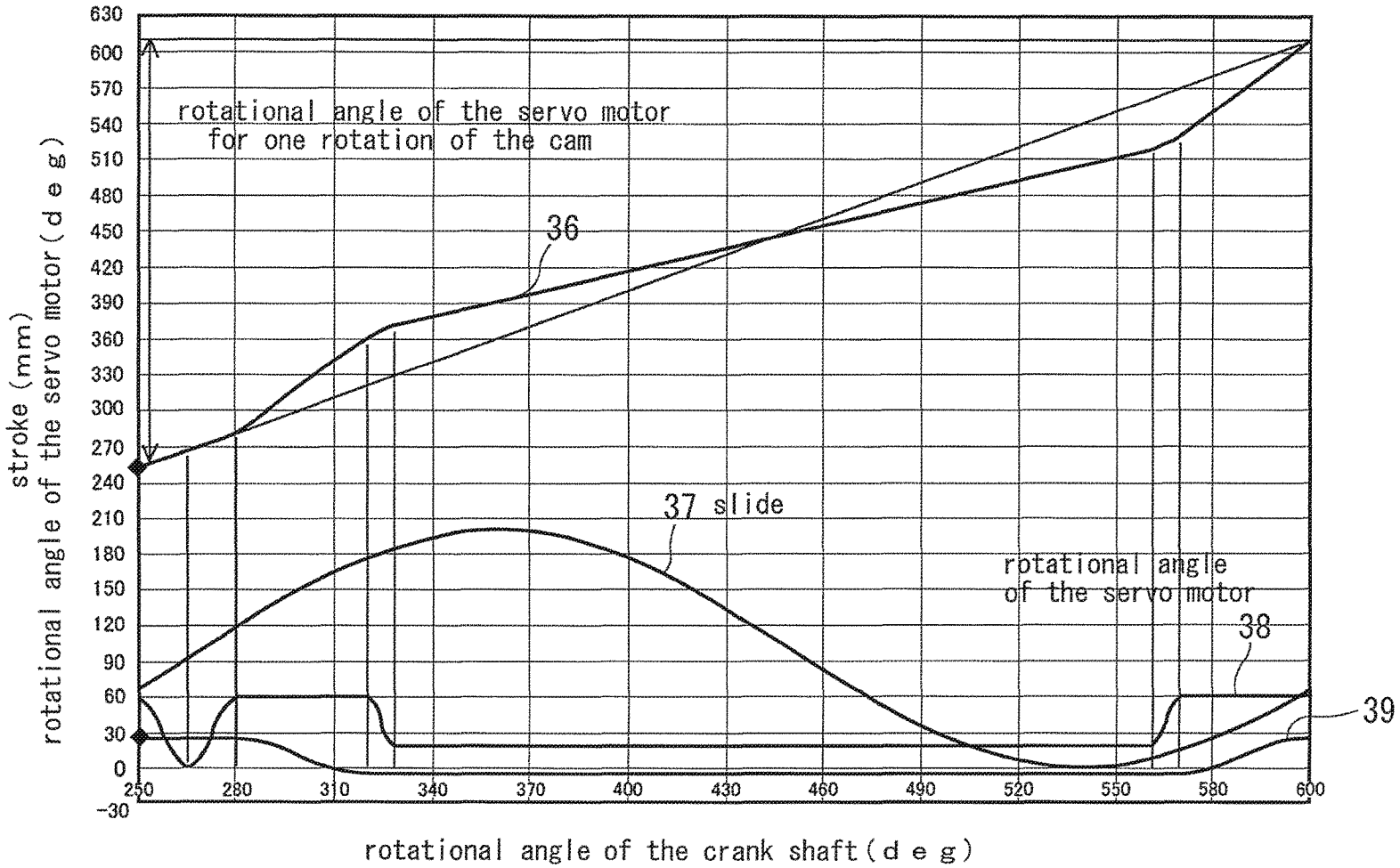

Next, referring to FIG. 7 showing the motion diagrams of the slide, the knockout pin and the like, the calculator 29 will be explained.

At first, the abscissa in the diagram is crankshaft angle (deg.) of a press machine, and the ordinate is stroke (mm.) of the slide of the press machine and rotational angle (deg.) of the servo motor. The curve mentioned with mark 36 is a rotational angle of the servo motor which drives the cam 22. Under the curve 36, a slide curve 37 is shown. And the curve mentioned with numeral 38 under the slide curve 37 is revolution number of the servo motor. Further, under the revolution number 38, a motion curve 39 is shown. The motion curve 39 is the target curve which corresponds to a motion of the knockout pin in the suitable timing for a certain work.

On the basis of this diagram, in the motion curve 39, the angle of motion is 81 degree and a holding angle of the knockout pin at the top end is 81 degree (from 250 degree to 280 degree in crankshaft angle)

The servo motor is controlled so as to assist the rotation of the cam 22 which is the standard, in order to obtain the target motion curve 39. In the calculator 29, crankshaft angle 31 is obtained in a prescribed timing, and the target angle is calculated on the base of the crankshaft angle 31. And the target angle is transmitted to the controller 28, to control the rotation of the servo motor so as to obtain the target motion curve 39.

5. Example

Hereinafter, referring to FIG. 8 and FIG. 9, an example of press machine using a press system 20 will be explained. The drawing shows a partially sectional view of a lower important portion of a press machine 1 having a press system 20. In this embodiment, the servo motor 21 is mounted on a frame of the press machine 1, and the output shaft is connected to a reduction gear 21*a* to transmit the rotational force to the cam 22. The cam 22 is attached on the frame of the press machine 1 so that the cam can rotate around an axis extending perpendicular to the direction of slide-stroke.

The press machine 1 has a knockout bar 17 on the lower frame so that the knockout bar can move up and down. The knockout bar 17 has at least one knockout pin 23. The knockout bar 17 has further a roller 18 on the opposite side to the knockout pin 23. The roller 18 can roll along the cam surface. And the device has further left and right urging mechanisms 19, 19 for urging the both ends of the knockout bar 17 toward cam 22 side.

The knockout bar 17 is mounted on the center portion in the front and rear direction or the neighborhood thereof, so as to bridge left and right portions so that the knockout bar can move up and down. And knockout pins 23 are attached on the upper surface of the knockout bar. Further, the knockout bar 17 has extended portions 17*a*, 17*a* on both ends which extends beyond the lower frame of the press machine 1. Those extended portions are pushed down by the urging mechanisms 19 such as air cylinders.

The knockout bar 17 has a curve-like recessed space on the center area of the under surface thereof, and the roller 18 is arranged in the space. The extended portions 17*a*, 17*a* are provided on the left and right positions of the roller 18 so that the roller 18 is a center of the extended portions. The extended portions 17*a*, 17*a* are connected with the urging mechanisms 19, and the connection positions with the urging mechanisms 19, 19 are the same height of the rotary center of the roller 18. Further, the urging force of the left and right urging mechanisms 19, 19 effect to the knockout bar 17 in balance on the left and right sides of the roller 18, and the knockout bar 17 is guided in up-and-down direction by the frame of the press machine 1. Therefore, the knockout bar 17 can smoothly move up-and-down.

Figure 8:
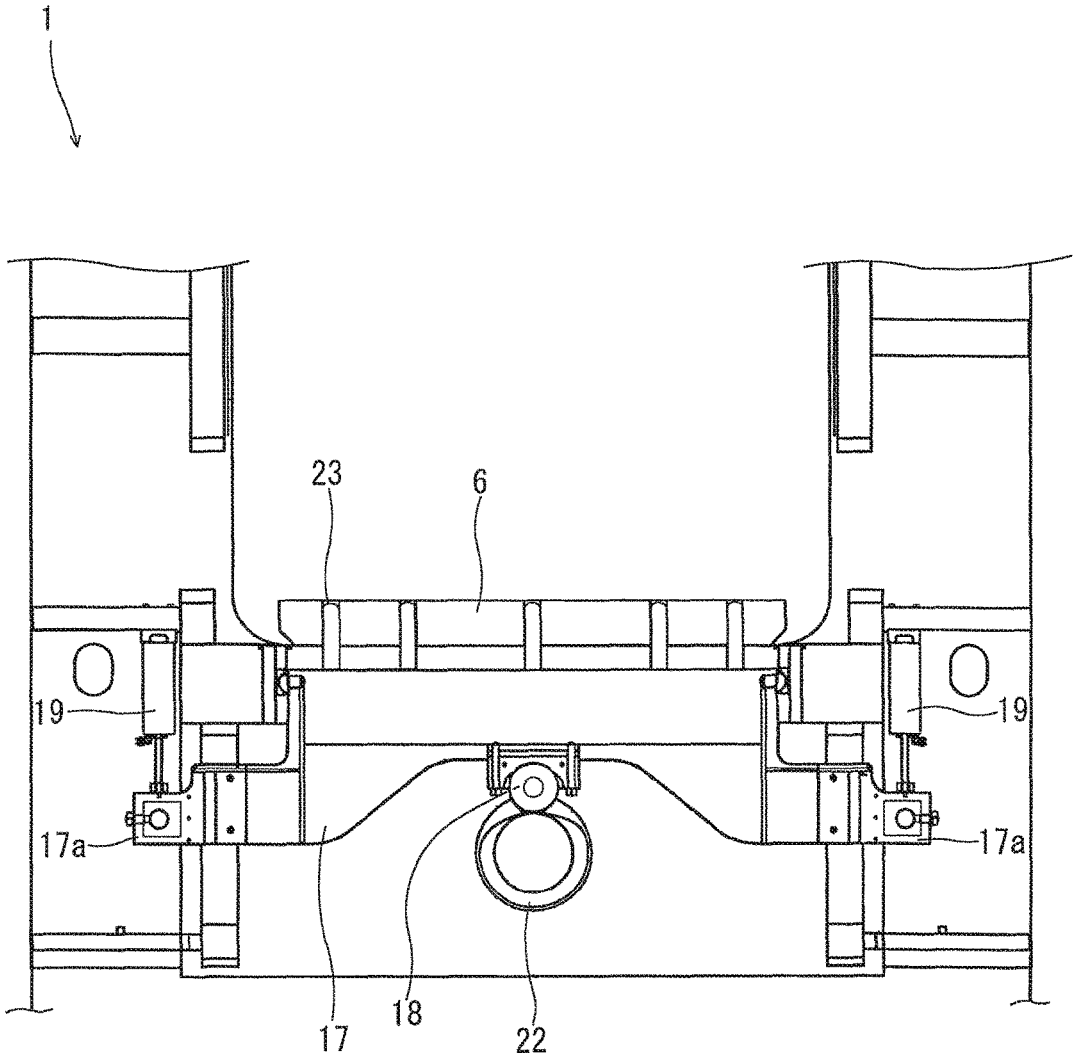
[FIG. 8] A sectional view of an important portion of the press machine according to the present invention.
Figure 9:
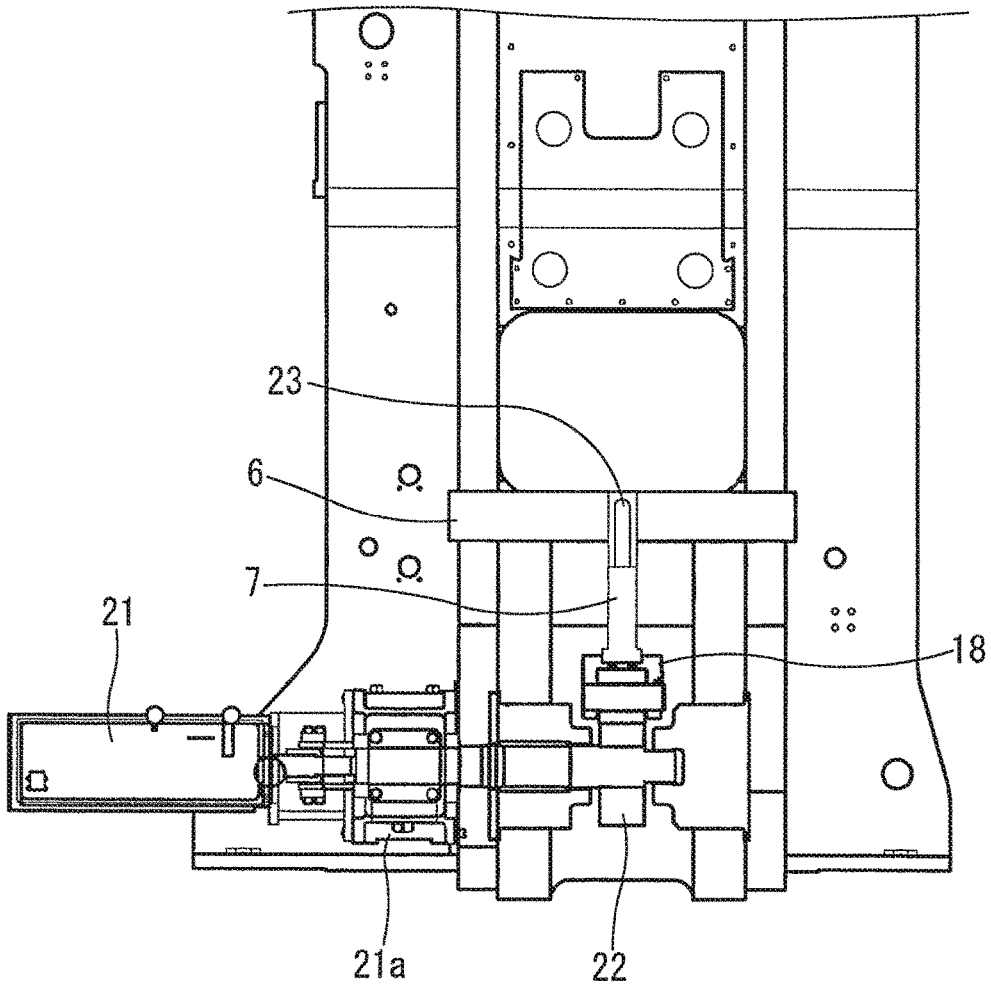
[FIG. 9] A schematic sectional view of FIG. 8.

In FIG. 8, knockout pins 23 are at the lower dead point and are stored in the bolster. The top end surfaces of the knockout pins are lower a little than the upper surface of the bolster.

The roller 18 is mounted on the knockout bar 17 at the lower side of the center portion in the left and right direction, so that the roller 18 can rotate around an axis of a shaft extending front-rear direction. Then, since the roller 18 rolls over the cam surface, friction descends. However, the end of knockout bar can be directly in contact with the cam 22 to slide over the cam surface.

As the urging mechanism 19, a spring, an air cylinder, a hydraulic cylinder, and the like can be employed. Generally, an air cylinder is used. The upper end of the urging mechanism 19 is fixed to the frame of the press machine 1, and the lower ends are abutted against the extended portions 17*a*, 17*a* to urge the upper surfaces thereof downward.

The knockout bar 17 can lift and lower multiple knockout pins simultaneously and securely. Further, since the servo motor 21 is accelerated and decelerated so as to assist the rotation of the cam on the basis of the standard shape of the cam, a target motion of the knockout pin with optimal timing can be obtained by merely arranging deforming the standard motion curve based on the cam shape, without exchanging the cam or changing attaching angle of the cam to the shaft. Further, in another embodiment, the knockout bar can be divided to several pieces. In such case, each piece can be lifted and lowered by respective servo motor.

6. Transfer System

Next, referring to FIG. 10, the press system 51 (see FIG. 12*a*) will be explained of the present invention.

Figure 10A:
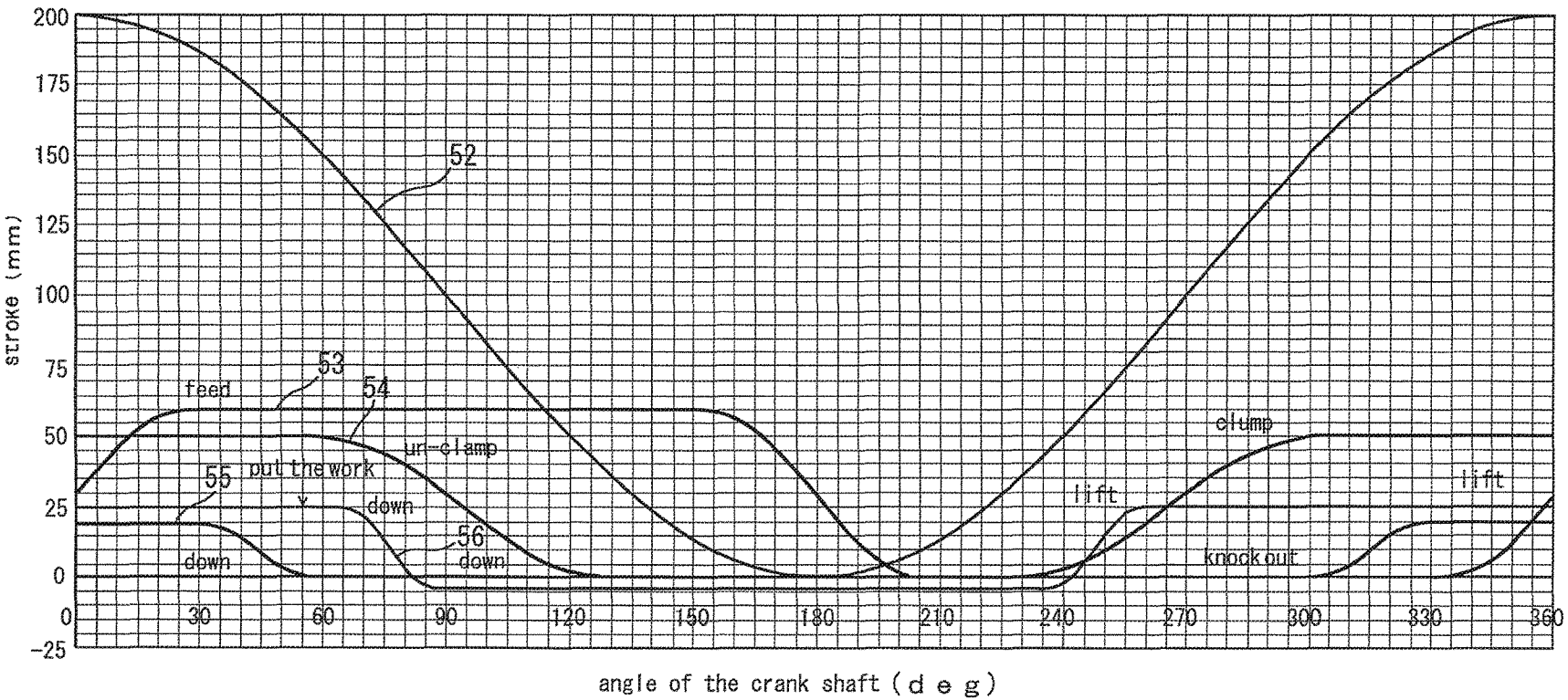
FIG. 10*a* is a timing diagram showing a slide curve, a set of curves of operation of feed bars and a varied motion of the knockout pin, respectively of an embodiment of the present invention.

The axis of abscissa in FIG. 10*a* shows angle (deg.) of the crankshaft, and the axis of ordinate shows each stroke (mm.) of a slide 10, feed-bars 15, 15 and knockout pins 23. In FIG. 10*a*, the upper curve mentioned by numeral 23 is a slide-curve showing stroke of the slide of press machine. The numeral 53 denotes a curve showing stroke of advance/return (go-forward/go-back) of the feed-bars 15. The numeral 54 denotes a curve showing stroke of clamp/unclamp (hold/release). The numeral 55 denotes a curve showing lift/down (go-up/go-down) of the feed-bars 15. The numeral 56 denotes a target motion curve showing a stroke of knockout (lift) and down.

Figure 10B:
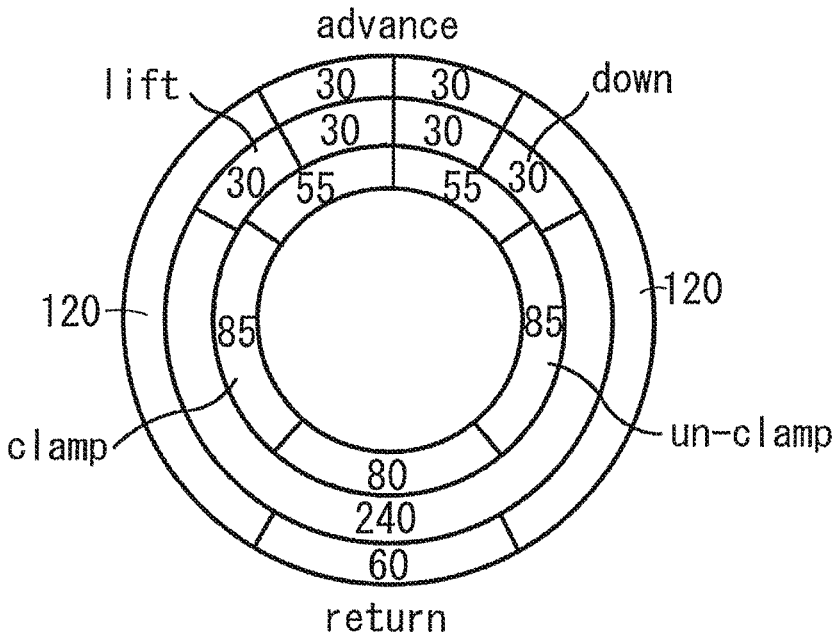
FIG. 10*b* is a schematic view of an angle of a crankshaft in which a motion of the feed bars are allocated.

Further, FIG. 10*b* is an allocation circle in which the motions of FIG. 10*a* are allocated as angle of the crankshaft. For example, with respect to operation of un-clamp, the operation starts at 55 degree of the crankshaft angle and continues 85 degrees from the start point to terminate at 140 degree.

The present embodiment of the press machine is operated under the following conditions.

Conditions

1. Press machine is operated by 30 SPM (stroke per minute); the speed of the knockout pin is 100 SPM.
2. Amount of the stroke of the press machine is 200 mm, and the stroke of the knockout pin is 29 mm.
3. Standard angle of the descending start based on cam shape is 280 degree, and standard angle of the ascending termination is 250 degree. Now, "the standard angle of the descending start" and "the standard angle of ascending termination" are the timing of the descending start and the ascending terminate of the cam in the motion curve of knockout pin as the crankshaft angle of the press machine, when the rotational angle of the cam is accorded to the crankshaft angle.
4. The timing of descending start and ascending terminate of the cam in a target motion curve of the knockout pin are 260 degree and 65 degree in the press crankshaft angle, respectively. I That is to say, the descending start angle is set to 65 degree, and the ascending terminate angle is set to 269 degree.
5. Stroke of advance of the feed-bars is 60 mm, stroke of the clamp is 50 mm, and the lift is 20 mm.

Figure 12A:
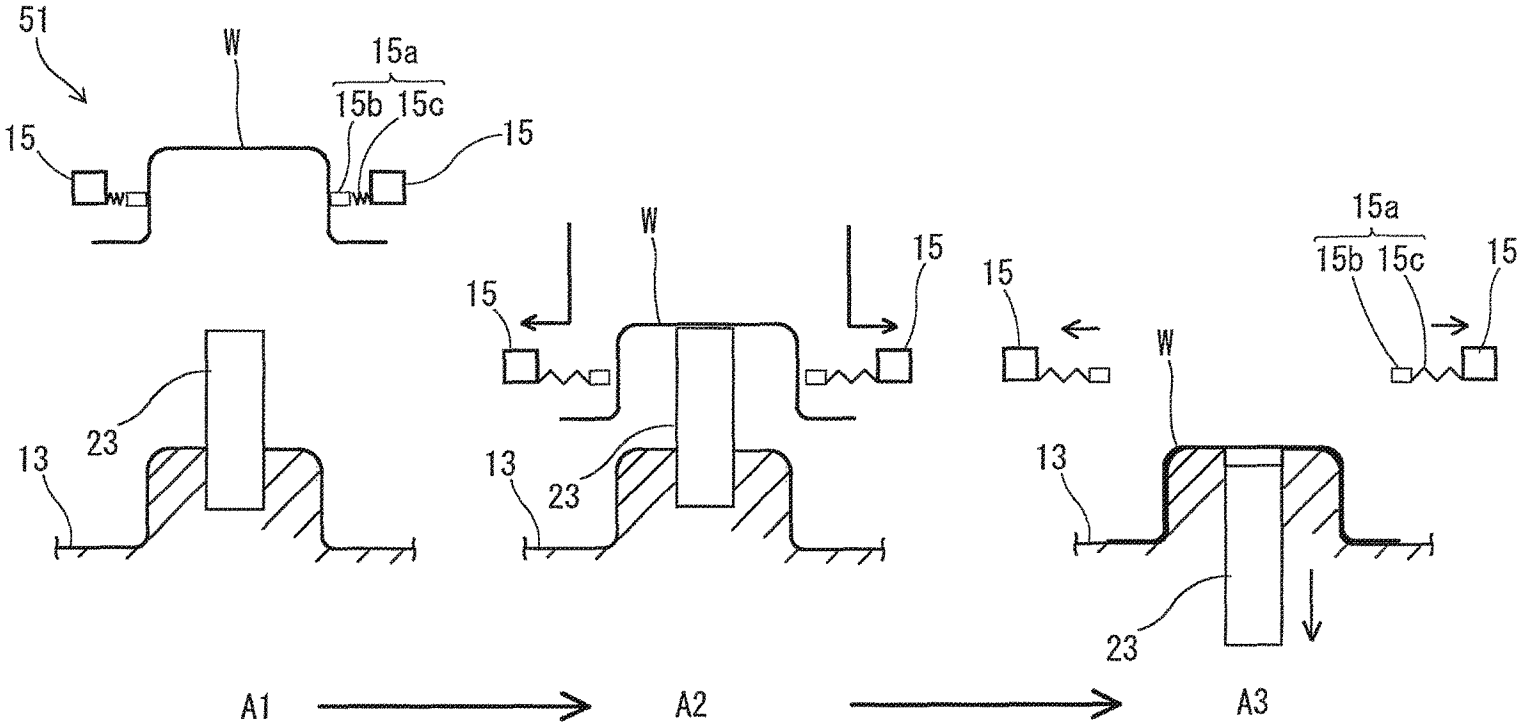
FIG. 12*a* is a schematic process diagram showing a state of the work which is set in a die by the press system of FIG. 11.

Hereinafter, motion of the system will be explained with reference to FIG. 10 and FIG. 12*a*. In the area from 330 degree to 30 degree of the crankshaft angle, the feed-bars clamping work W advance and transfer the work W to the position over the lower die 13 (see A1 of FIG. 12*a*). Next, in the area from 30 degree to 60 degree, the feed-bars descend. In this situation, the knockout pin is arranged so that the upper surface of the lifted knockout pin become in contact with or in the neighborhood to the lowering work clamped by the feed-bars.

At the crankshaft angle 55 degree where just before the descending of the feed-bars terminate, the feed-bars start un-clamp operation. At the same time of the un-clamping by the feed-bars, the work W is put on the top surface of the knockout pin 23 (see A2 of FIG. 12*a*).

Next, at 65 degree of the crankshaft angle, the knockout pin starts to descend. And when the upper surface becomes lower from the upper surface of the lower die 13, the work W is put in the lower die (see A3 of FIG. 12*a*).

Another Press System

Figure 11A:
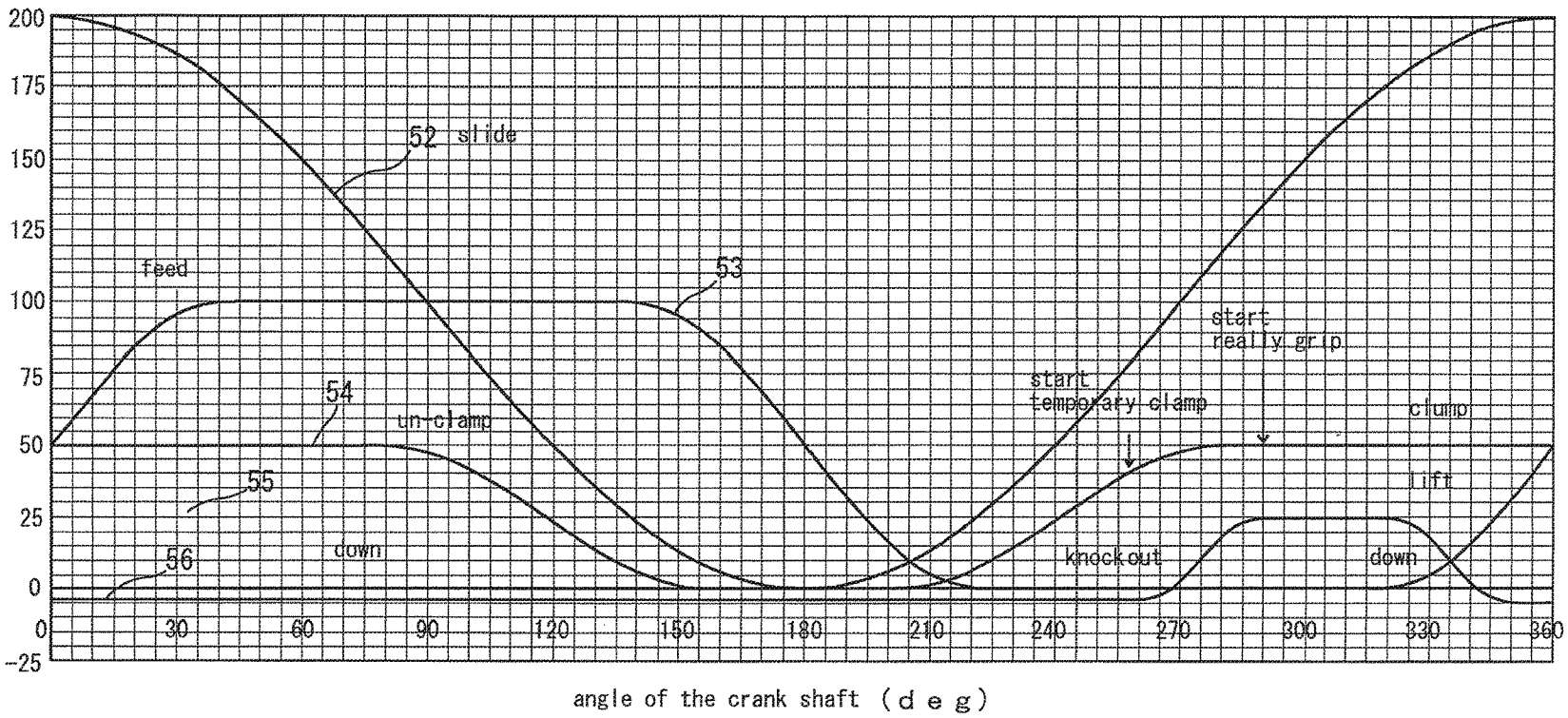
FIG. 11*a* is a timing diagram showing a slide curve, a net of curves of operation of feed bars and a modified motion of the knockout pin, respectively of another embodiment of the present invention.
Figure 11B:
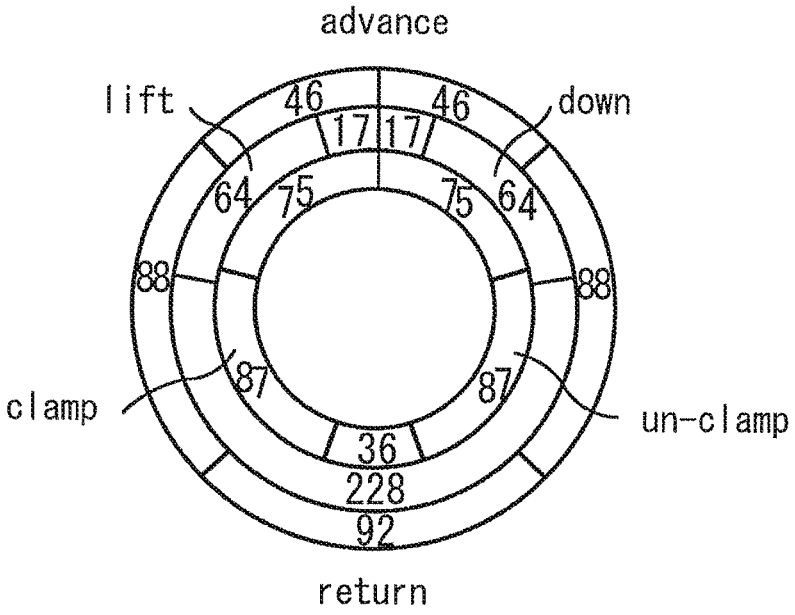
FIG. 11*b* is a schematic view of an angle of a crankshaft in which a motion of the feed bars are allocated.

Next, another embodiment of press system of the present invention will be explained with reference to FIG. 11. FIG. 11 is a timing diagram of a press system 57 shown in FIG. 12*b*. Explanation about the marks and numerals in FIG. 11 and contents of conditions are the same as that explained for the press system 51. Therefore, detailed explanation is omitted with attaching the same marks and numerals for the same portions. Further, within the conditions applied to the press system 57, conditions different from the conditions for the press system 51 will be described as follows.

Conditions

Operation speed of the knockout pin is 80 SPM.

Ascending terminate angle is 290 degree, and descending starting angle is 320 degree.

Figure 12B:
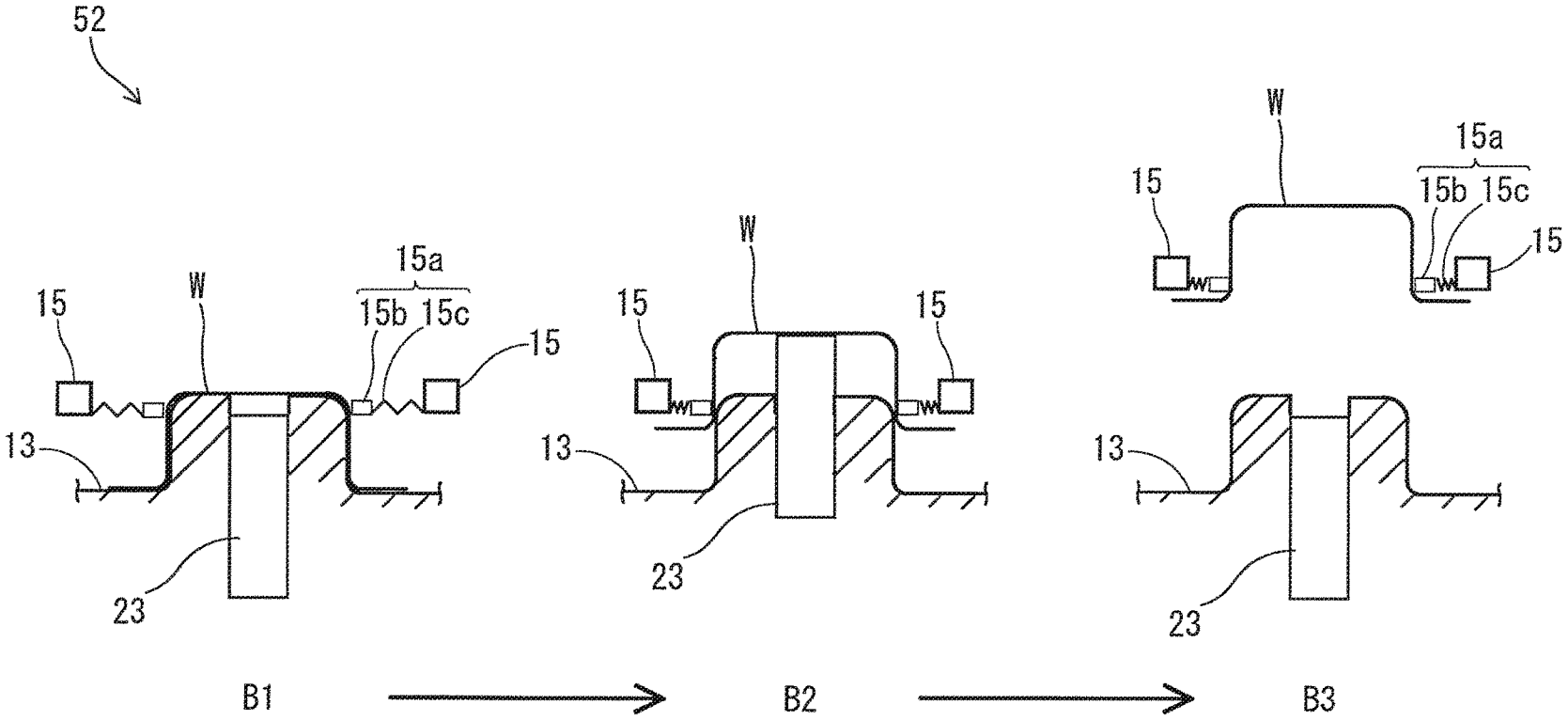
FIG. 12*b* is schematic process diagram showing a state of the work W which is picked out from a die by the press system of FIG. 10.

In this press system 57, the work W is gripped at an angle before the angle of 260 degree of the crankshaft (see B1 of FIG. 12*b*). This grip operation is temporary grip. This temporary grip is performed with such weak force that the work W can be shifted in the knockout direction. After the temporary grip, the work W is knocked-out from the lower die by the knockout pin, so that the temporary grip position is sifted. Then, the feed-bars operate to really grip the work W (see B2 of FIG. 12*b*). After the real grip, the feed-bar ascend, and knockout pins descend (see B3 of FIG. 12*b*).

In the present embodiment, during the clamp operation of the feed-bars 15, 15 (see mark b in FIG. 13), the knockout pins are lifted. And, early stage of the clamp operation, the temporary holding mechanism 15*a* is in contact with the work W, so that the mechanism is in a condition that the work can be temporary clamped. Therefore, as the clamping progresses, the force to hold the work ascends gradually, and real holding is performed at last.

The temporary clamp or grip is a concept including at least a state in which the work W is prevented from pop-up due to push of the knockout pin, and the work W is allowed to move in the knockout direction.

The real hold is a concept including a state that feed-bars 15, 15 clamp the work W to transfer the work to the next die or the like. The clamping state is such state that gripping force acts sufficiently so as to lift and transfer the work W without dropping. The grip force can be the same as the force of the temporary holding or can be about the force.

The feed-bars 15, 15 are provided with temporary holding mechanisms 15*a*, 15*a*, respectively. For example, the temporary holding mechanism 15*a* has a finger 15*b* to grip the work W and an urging member 15*c* for urging the finger toward the work W side (clamp direction shown by arrows "a" in FIG. 13). The finger 15*b* is a plate-like member having a cut-out portion (not shown in drawing) for receiving a work W. The urging member 15*c* is a member having a mechanism which effects a repulsion force against a pressing power such as a coil spring, pneumatic damper, and the like.

5-2. Defomed Embodiment

In the data table mentioned in FIG. 5, lift amount of the knockout pin 23 can be stored in replace of the target angle 26 so that the target angle can be obtained by the obtaining means 27 in basis of the program which calculates a target angle 26 from the lift amount and the crankshaft angle 31.

The press system 20 mentioned in FIG. 8 can be constructed so that the roller 18 is in contact directly with the knockout pin 23 without using knockout bar 17. Further, the system can be constructed so that the cam 22 is in contact with the knockout pin directly, without using the knockout bar 17 and the roller 18. Further, the system can be constructed so that the cam 22 is in contact with the knockout bar directly, without using the roller 18. In that case, it is preferable to provide a smooth surface to the knockout bar 17 which can slide with the cam 17.

The above-mentioned temporary holding can be used as a guiding mechanism for guiding the work W to the knockout direction, without acting the grip function, or acting the grip function few.

Further, the temporary holding member 15*a*, as whole body, can be made of an elastic or elastomeric member such as rubber, soft plastic and the like. Such temporary holding mechanism 15*a* can deform along the outer shape of the work W, and can grip the work W by repulsion force due to the elastic deformation force, when the feed bars grip the work with prescribed force during the grip operation. Further, as the temporary holding mechanism 15*a*, not only repulsing force using an urging member or an elastic member, but also suction force by air or magnetic holding force by electrical magnet, for example, can be employed to prevent pop-up of the work W. It is preferable that such suction force or magnetic attractive force can be controlled by on-off operation so that the force functions temporarily at temporary holding timing. For example, the pop-up of work W may be prevented by using the suction force or electric attractive force without adding a grip force due to the clamp operation or with adding little force.

In order to make secure the motion of the work W in the knockout direction, it is preferable to hold temporarily the clamp operation of the feed-bars 15, 15 during lift up motion of the knockout pin, so that the grip force of the temporary holding is fixed to a certain value.

The invention claimed is:

1. A knockout system for knocking out a work positioned on a lower die, the lower die attached to an upper surface of a bolster on a bed of a press machine, the press machine including an upper die configured to move up and down via a crankshaft, the knockout system comprising:

a cam mounted on the bed of the press machine;

a servo motor which drives the cam to be rotated with the same cycle time as that of the crankshaft of the press machine;

a knockout pin which is moved with reciprocal linear motion by the rotation of the cam to knock out the work from the lower die of the press machine;

a crankshaft angle detector configured to detect a present absolute angle information of the crankshaft of the press machine;

a cam angle detector configured to detect a present angle information of the cam; and a control unit configured to obtain a target angle information of the cam based on the detected present absolute angle information of the crankshaft;

wherein the control unit comprises a controller configured to control the servo motor so that the present angle information of the cam becomes the target angle information of the cam, the controller being further configured to change a basic motion of the knockout pin according to a contour of the cam to a target motion obtained from the target angle information.

2. The knockout system according to claim 1, further comprising a knockout bar mounted on a frame of the press machine in a manner capable of up and down motion, the knockout pin being supported by an upper side of the knockout bar;

a roller attached on a lower side of the knockout bar, so that the roller rolls along the contour of the cam; and an urging member which urges the knockout bar toward the cam so that the roller abuts to the cam.

3. The knockout system according to claim 1, wherein the control unit obtains the target angle information of the cam based on the present absolute angle information of the crankshaft of the press machine, with reference to a data table in which the target angle of the cam corresponding to the present absolute crankshaft angle of the press machine is preliminarily registered in the memory.

4. The knockout system according to claim 1, further comprising a calculator configured to calculate the target angle information of the cam corresponding to the present absolute angle of the crankshaft of the press machine.

5. A press system for knocking out a work from a lower die attached to a press machine, the press system comprising:

a cam mounted on a bed of the press machine;

a servo motor which drives the cam to be rotated with the same cycle time as that of a drive mechanism of a slide of the press machine;

a knockout pin which is moved with reciprocal linear motion by the rotation of the cam;

a detector configured to detect a present angle information of the cam;

a memory storing a target angle information of the cam;

a knockout bar mounted on a frame of the press machine in a manner capable of up and down motion, the knockout pin being supported by an upper side of the knockout bar;

a roller attached on a lower side of the knockout bar, so that the roller rolls along the contour of the cam; and an urging member which urges the knockout bar toward the cam so that the roller abuts to the cam; and a controller configured to control the servo motor in accordance with the present angle information and the target angle information, the controller being further configured to change a basic motion of the knockout pin according to contour of the cam to a target motion obtained from the target angle information.

* * * * *